United States Patent [19]

Borowski

[11] Patent Number: 4,763,854

[45] Date of Patent: Aug. 16, 1988

[54] CONTAINER FOR CONTINUOUS SUPPLY OF WIRE

[75] Inventor: Robert A. Borowski, Lockport, Ill.

[73] Assignee: A. Johnson Metals Corporation, Lionville-Exton, Pa.

[21] Appl. No.: 159,198

[22] Filed: Feb. 23, 1988

[51] Int. Cl.[4] ..... B65H 49/06

[52] U.S. Cl. ..... 242/129; 242/171

[58] Field of Search ..... 242/129, 128, 77, 77.2, 242/159, 170, 171, 172, 105

[56] References Cited

U.S. PATENT DOCUMENTS

| | | | |
|---|---|---|---|
| 3,107,880 | 10/1963 | Lawlis | 242/129 |
| 3,118,634 | 1/1964 | Shumake | 242/129 |
| 3,664,601 | 5/1972 | Richardson, Jr. | 242/129 |
| 4,651,948 | 3/1987 | Delehouzee et al. | 242/129 |

FOREIGN PATENT DOCUMENTS

| | | | |
|---|---|---|---|
| 1073719 | 3/1954 | France | 242/129 |
| 639863 | 5/1962 | Italy | 242/129 |

*Primary Examiner*—Stanley N. Gilreath
*Attorney, Agent, or Firm*—Brumbaugh, Graves, Donohue & Raymond

[57] ABSTRACT

In the representative embodiment of a container for continuous supply of wire described in the specification, a coil of wire is supported between two side members joined at their outer peripheries. One of the side members has a continuously circular opening formed by a bar with a central circular section and axially spaced ends extending in opposite directions to the periphery of the side member. Wire from the inner surface of a coil of wire held in the container is supplied through the circular opening and the end of the wire from the outside of the coil is disposed above one end of the bar and below the other end of the bar so that it can be connected to another coil of wire and wire can be supplied continuously from successive containers.

6 Claims, 1 Drawing Sheet

CONTAINER FOR CONTINUOUS SUPPLY OF WIRE

BACKGROUND OF THE INVENTION

This invention relates to containers for holding coils of wire and permitting wire to be withdrawn continuously from several containers in succession and, more particularly, to such a wire coil container having a simple and convenient structure arranged to permit withdrawal of wire from successive containers in a more effective manner.

In certain cases, it is necessary to provide a container for holding a coil of wire in such a way that the wire can be withdrawn continuously through one side of the container from the inner surface of the coil while the container is held stationary. Moreover, to facilitate such continuous supply of wire from several coils in succession without interruption, it is necessary to connect the outer end of one coil of wire with the inner end of the next coil of wire and, accordingly, the outer end of each coil must pass from the inside to the outside of the container without interfering with the feeding of wire from the inner surface of the coil.

Heretofore, relatively complex container structures for feeding wire have been provided. For example, in U.S. Pat. No. 4,651,948, a wire package is disclosed in which one side has a wire feed opening formed by a central circular ring with an outwardly open notch in the ring which is tapered in one direction and has an axially-directed projection. Another coil container has a tear-drop shaped wire feed opening in one side formed by a bar having both ends affixed in overlapping relation to a support bar at the outer periphery of the container and extending generally tangentially therefrom toward a central segment which is circular in shape and surrounds only about three quarters of the wire feed opening. Such complex structural arrangements are inconvenient to manufacture and may cause difficulty in feeding of the wire from the center of the coil.

SUMMARY OF THE INVENTION

Accordingly, it is an object of the present invention to provide a new and improved wire container having a simple structure which is convenient to manufacture and enables smooth feeding of wire from the center of a coil and which permits connection of the outer end of the wire in the coil in one container to the wire in the coil in another container in a convenient manner.

These and other objects of the invention are attained by providing a container for holding a coil of wire having a side structure with an uninterrupted circular opening, wherein one segment of the circle is formed by circularly overlapping, axially adjacent bar members attached to circumferentially spaced points of the periphery of the container. Preferably, the uninterrupted circular opening is formed by a bar having a central portion of circular shape having sections disposed in adjacent relation at a common segment of the circle and end portions extending therefrom in opposite directions toward the periphery of the container where they are attached to the peripheral structure of the container thereby permitting the outer end of a coil of wire held in the container to pass over one of the oppositely directed ends of the bar and under the other end so as to be movable into the circular opening. In addition, the circular portion of the bar is joined to the peripheral structure of the container by radial support bars.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENT

Figure 1:
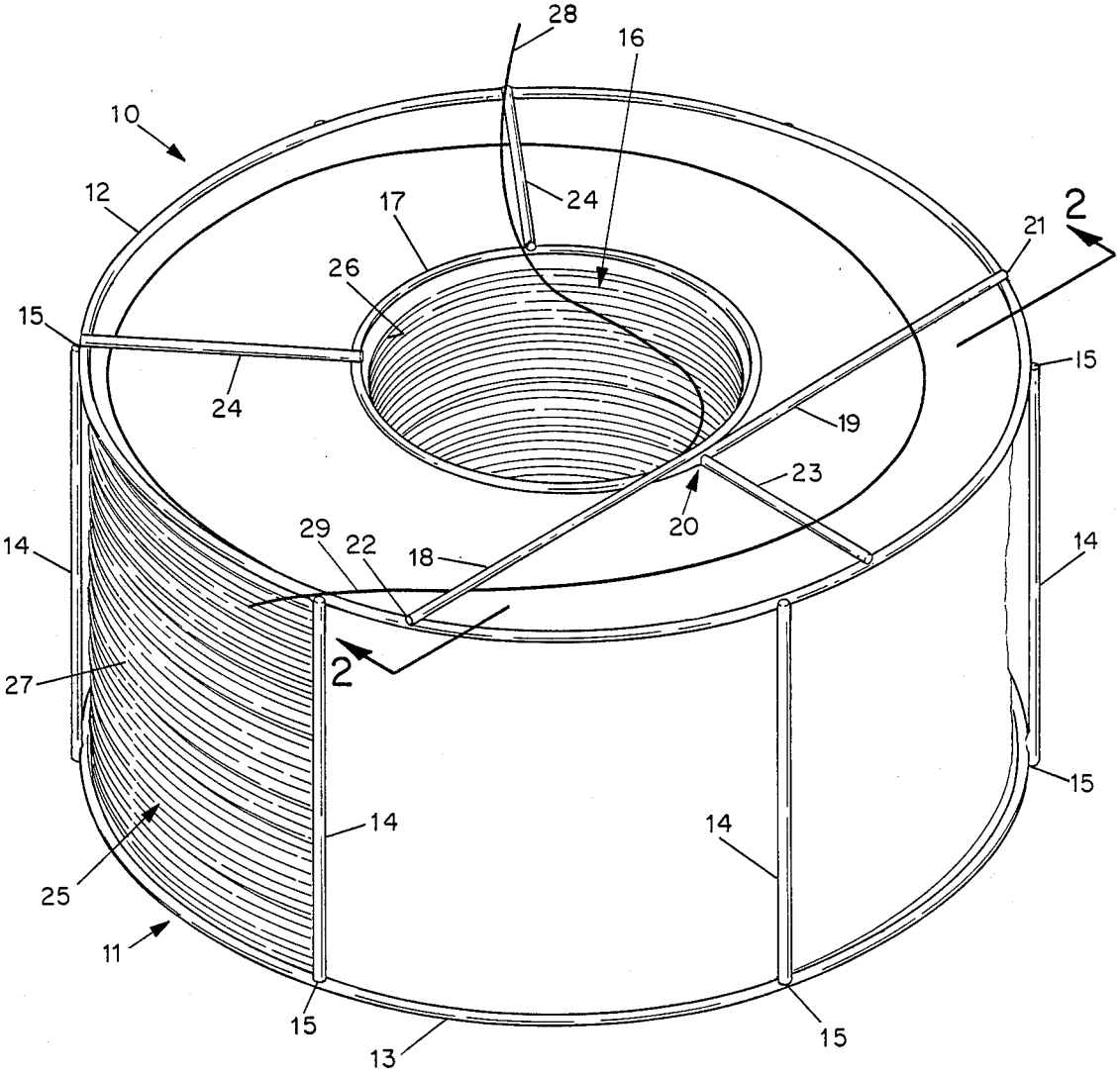
FIG. 1 is a perspective view illustrating a representative container for continuous supply of wire arranged in accordance with the invention.

In the typical wire feed basket arranged according to the invention as shown in the drawings, two disc-shaped side structures 10 and 11 having circular outer rings 12 and 13, respectively, are joined at their outer edges in spaced parallel relation by a series of spacing bars 14 rigidly connected, as by welding, at joints 15 at each of the rings 12 and 13. In the illustrated embodiment, six spacing bars 14 are provided, only four of which are visible in FIG. 1, but it will be apparent that any number of spacing bars consistent with good structural integrity may be used. To complete the lower side member 11, which is not visible in FIG. 1, three angularly spaced crossbars may be rigidly joined at their opposite ends as by welding to diametrically opposed points on the ring 13, and they are preferably joined in a similar manner at their central intersection.

On the upper side of the container as seen in FIG. 1, the disc-shaped side structure 10 has a continuously circular central opening 16 formed by a bar member having a circular central portion 17 and two end portions 18 and 19 which extend in opposite directions from a common segment 20 of the circular central opening. The ends of the end portions 18 and 19 are rigidly jointed as by welding to the ring 12 at points 21 and 22, respectively, which are spaced by about one third the circumference of the ring. As best seen in the fragmentary side view of FIG. 2, wherein a portion of the ring 12 has been cut away for purposes of illustration, the end portions 18 and 19 are disposed in adjacent spaced relation in the region 20 where they overlap and commence the formation of the circular portion 17. In this way the central opening 16 of the side member 10 is formed as a continuous circle. Additional support for the central circular portion 17 is provided by a radial support bar 23 which is rigidly joined as by welding to the outer ring 12 and to the central circular portion 17 where it joins the lower end portion 19 (as viewed in FIG. 1) at the segment 20 and two radial support bars 24 which join the ring 12 and the ring portion 17 on the side away from the segment 20.

Figure 2:
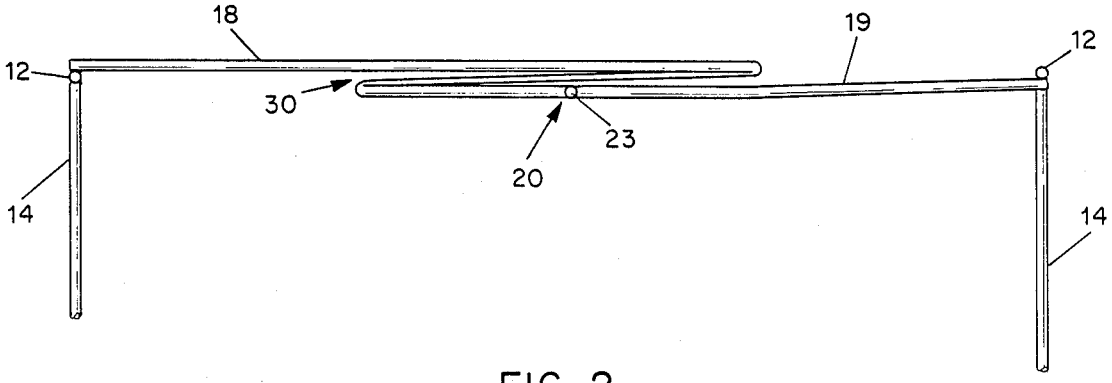
FIG. 2 is a fragmentary side view of the representative container shown in FIG. 1, looking in the direction of the arrows 2—2.

A coil of wire 25, disposed within the container, is wound in successive layers from an inner surface 26 to an outer surface 27 so that the end 28 of the wire from the inner surface 26 of the coil may be fed outwardly from the container through the circular opening 16. On the other hand, the end 29 from the outer surface 27 of the coil extends from the inside of the container beneath the support bars 24, above the end 19 of the bar member forming the circular opening and the adjacent support bar 23 and below the oppositely directed end 18 of the bar member as shown in FIG. 1. As best seen in FIG. 2, when all of the wire from the coil 26 has been withdrawn through the circular opening 16, this arrangement permits the wire from the coil leading to the end 29 to pass between the bar ends 18 and 19 at the segment 20 of the circular opening. Consequently, the end 29 of the wire leading from the outer surface of the coil in the container can be connected to the inner end of another coil of wire held in a similar container (not shown) so that wire from several similar containers in succession can be fed without interruption. Moreover, such connections are permitted without requiring any interruption in the circular opening 16 which could disrupt the feeding of wire through the opening.

Preferably, the adjacent regions of the end portions 18 and 19 in the common segment 20 of the circular portion are spaced from each other by a gap 30 which is slightly wider than the thickness of the wire 29 to facilitate easy removal of the end of the wire from the container. If desired, however, the gap 30 between the end portions 18 and 19 may be narrower than the thickness of the wire 29 as long as there is sufficient resilience in the portions 18 and 19 to permit them to be separted as the end of the wire is pulled from the container.

Although the invention has been described herein with reference to a specific embodiment, many modifications and variations therein will readily occur to those skilled in the art. Accordingly, all such variations and modifications are included within the intended scope of the invention.

I claim

1. A container for a coil of wire comprising a support structure having two side portions spaced in the axial direction with respect to a coil to be held therein, the side portions being connected in spaced relation by a peripheral portion of the support structure, and means forming a continuously circular central opening in one of the side portions to supply wire from the center of a coil of wire held in the container, wherein the means forming the continuously circular central opening comprises bar means formed with a central circular portion and end portions projecting in generally opposed directions away from a common segment of the central opening, the circular portion and the end portions being disposed in axially adjacent relation at the common segment.

2. A container according to claim 1 wherein the side portion having a circular central opening includes a peripheral ring member and wherein the end portions of the bar means are attached to the peripheral ring member at angularly spaced locations thereon.

3. A container according to claim 2 including a plurality of support members joining the circular portion of the bar means to the peripheral ring member at angularly spaced locations.

4. A container according to claim 1 wherein the end portions of the bar means in the common segment of the circular central opening are spaced in the axial direction by a distance at least as great as the thickness of the wire in a coil of wire to be held in the container.

5. A container according to claim 1 including a coil of wire disposed within the container having the outer end of the wire in the coil extending from the interior of the container on the axially outer side of one end portion of the bar means which is disposed axially inside the other end portion at the common segment of the circular opening and thereafter extending on the axially inner side of the other end portion of the bar means.

6. A container according to claim 5 including a plurality of support members joining the circular portion of the bar means to the peripheral ring member at angularly spaced locations and wherein the outer end of the wire in the coil extends on the axially inner side of one support member and on the axially outer side of another support member.

* * * * *